US007290608B2

(12) United States Patent
Wittrisch

(10) Patent No.: US 7,290,608 B2
(45) Date of Patent: Nov. 6, 2007

(54) METHOD AND SYSTEM FOR PUMPING IN AN OIL WELL

(75) Inventor: Christian Wittrisch, Rueil Malmaison (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 254 days.

(21) Appl. No.: 10/937,388

(22) Filed: Sep. 10, 2004

(65) Prior Publication Data

US 2005/0061517 A1 Mar. 24, 2005

(30) Foreign Application Priority Data

Sep. 16, 2003 (FR) ..... 03 10890

(51) Int. Cl.
*E21B 43/00* (2006.01)

(52) U.S. Cl. ..... 166/266; 166/68.5; 166/105.2

(58) Field of Classification Search ..... 166/367, 166/350, 345, 266, 54.1, 373, 370, 68, 5, 166/105.2
See application file for complete search history.

(56) References Cited

U.S. PATENT DOCUMENTS

| | | | | |
|---|---|---|---|---|
| 4,100,967 | A * | 7/1978 | Allen et al. | 166/68 |
| 4,223,728 | A * | 9/1980 | Pegg | 166/266 |
| 5,829,529 | A * | 11/1998 | Cholet et al. | 166/369 |
| 6,190,141 | B1 | 2/2001 | Henry | |
| 6,543,543 | B2 | 4/2003 | Muth | |

FOREIGN PATENT DOCUMENTS

| | | |
|---|---|---|
| FR | 2 727 475 | 5/1996 |

* cited by examiner

*Primary Examiner*—David Bagnell
*Assistant Examiner*—Brad Harcourt
(74) *Attorney, Agent, or Firm*—Antonelli, Terry, Stout & Kraus, LLP.

(57) ABSTRACT

An effluent pumping method and system include a pump having a rotor and a stator, the rotor being fastened by a first end to a tubular driving string; a device for driving the string into rotation; and a riser having at least one orifice. The riser is fastened to the rotor at the second end thereof, and the rotor includes a line which communicates the inner space of the driving string with the inner space of the riser.

9 Claims, 1 Drawing Sheet

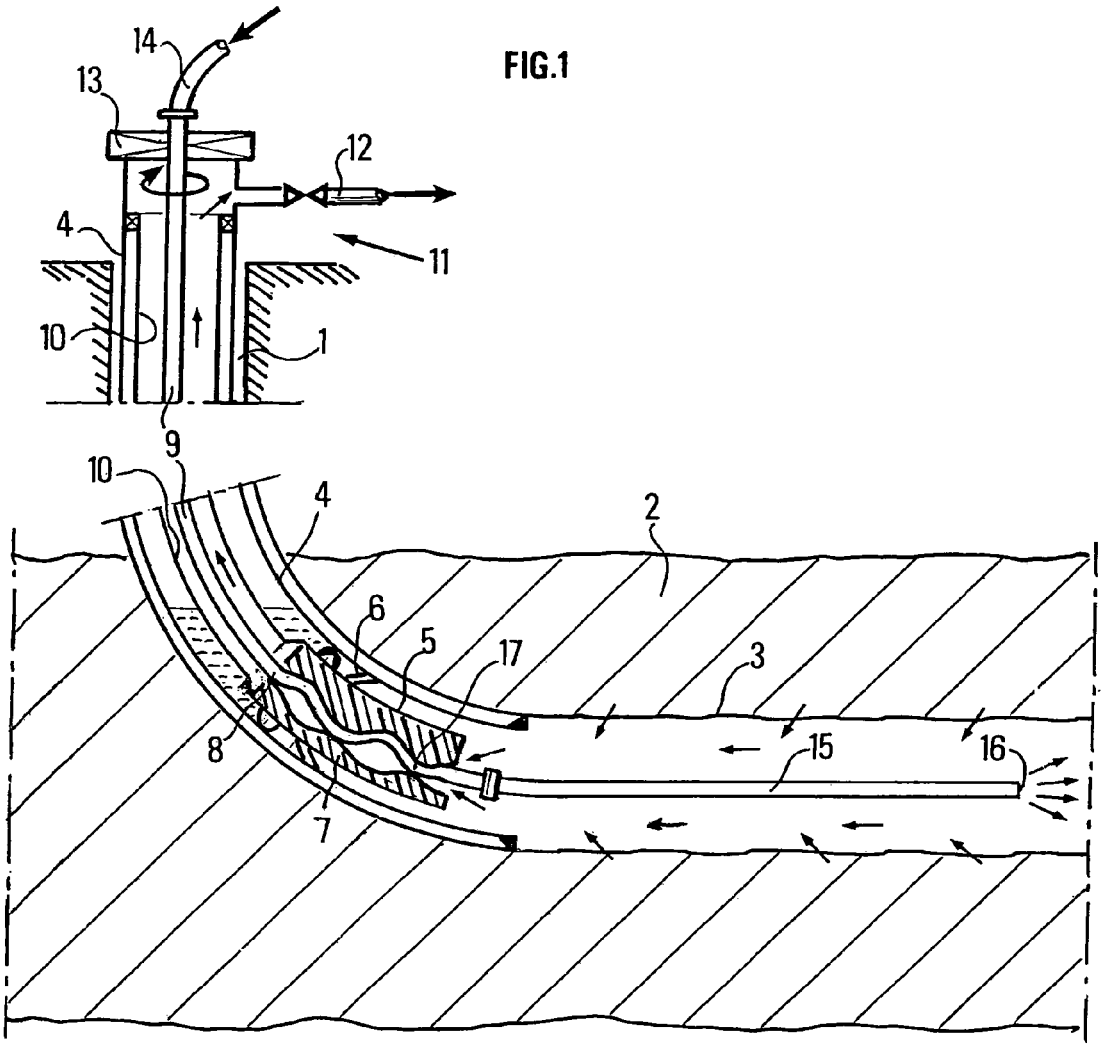
FIG.1
FIG.2
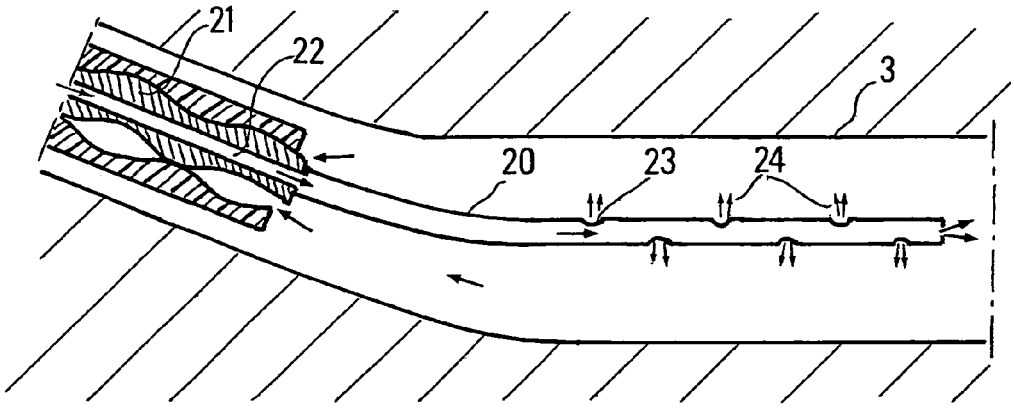

METHOD AND SYSTEM FOR PUMPING IN AN OIL WELL

FIELD OF THE INVENTION

The present invention relates to a method and to a system for producing hydrocarbons by pumping, particularly suited for viscous oil reservoirs.

BACKGROUND OF THE INVENTION

Document FR-2,692,320 describes a pumping device for viscous fluids, comprising injection of a fluidifying product upstream from the pump inlet. This device notably has the drawback of requiring an additional operation of setting a special line for injection of the product.

Document FR-2,727,475 describes a pumping device driven by a continuous tube wound from the surface, said tube allowing an additive to be injected downstream from the pump discharge end. However, the fluid at the pump inlet is not in contact with the additive and keeps such a high viscosity that the pumping efficiency can be affected thereby.

SUMMARY OF THE INVENTION

The present invention thus relates to a system for pumping an effluent produced by a well drilled through a producing geologic formation, comprising:

pumping means arranged in the lower part of the well so as to be immersed in said effluent, the pumping means comprising a rotor and a stator;

said rotor being fastened by a first end to a tubular driving string arranged in the inner space of said well;

means for driving said string into rotation so as to activate the pump. According to the invention, a riser comprising at least one orifice is fastened to the rotor at the second end thereof, the rotor comprising a line communicating the inner space of the driving string with the inner space of the riser.

The riser can comprise a plurality of orifices distributed over the length thereof.

The orifice can have a dimension so determined that a fluid injected into the continuous tube comes out of the riser in form of a jet.

The riser can be made of composite polymer.

The length of the riser can be determined as a function of the length of the effluent production drain hole.

The well can be cased and the pumping means can be arranged in the casing string.

The stator can be fastened to the base of a production string.

The invention also relates to a method for producing by pumping an effluent produced by a well drilled through a producing geologic formation, wherein the system according to the invention is implemented, and wherein a fluid suited to lower the viscosity of the effluent is injected into the continuous tube.

At least one of the following fluidifiers can be injected: hot water, steam, naphtha.

The fluid can be suited to emulsify said effluent.

BRIEF DESCRIPTION OF THE FIGURES

Other features and advantages of the present invention will be clear from reading the description hereafter of non limitative embodiment examples, with reference to the accompanying figures wherein:

FIG. 1 diagrammatically shows the system according to the invention,

FIG. 2 shows more in detail the system according to the invention.

DETAILED DESCRIPTION

FIG. 1 shows a well 1 drilled from the surface to a geologic zone 2 producing an effluent, a petroleum effluent for example. Well 1 is continued in this geologic zone by a drain hole 3 drilled substantially horizontal so as to run through the producing layer over a greater length.

A string of tubes 4 covers the walls of the wellbore, substantially up to producing layer 2. The main purpose of this casing string is to stabilize the borehole and to allow installation of all the production means necessary for development of producing layer 2, for example a production string, pumping means, control valves, etc.

As the producing layer is not, in the present case, "eruptive", a pump is necessary to drive the effluent up to the surface. Pumping means 5 are installed in casing string 4 by means of anchor and annular seal means 6. According to the invention, the pumping means comprise a positive-displacement pump consisting of a stator 7 fixed in relation to casing 4 and of a rotor 8 driven into rotation by a continuous tube 9 of coiled tubing type. Documents FR-2,727,475 and U.S. Pat. No. 5,667,369 describe the means and the implementation of the pumping means by means of a continuous tube suited to be wound and unwound from a winch drum arranged at the surface. Another string of tubes 10 can be connected to stator 7 of the pump, but in some configurations, the effluent discharged to the surface can directly circulate within string 4. The pumping means are placed at such a depth in the well that they remain immersed in the effluent during pumping. Considering the pump driving mode from the surface, the pump is generally not installed in a well portion inclined by more than 70°.

According to FIG. 1, the effluent produced flows towards wellhead 11 through the inside of string 10 prior to being discharged through flowline 12. Continuous coiled tubing 9 is driven into rotation by rotating means 13. Wellhead installation 11 is completed by a line for injecting a fluid into continuous tubing 9. The surface elements can be similar to those described in document U.S. Pat. No. 5,667,369.

A riser 15 equipped with at least one orifice 16 allowing injection of a fluid into the drain hole is fastened to the second end of rotor 8 (continuous tubing 9 is fastened to a first end of the rotor).

Rotor 8 comprises a line 17 running through it over the total length thereof so as to communicate the inner space of continuous tubing 9 and the inner space of riser 15. Line 17 can be pierced or result from manufacture of a hollow rotor.

FIG. 2 shows more precisely a riser 20 fastened to the end of a rotor 21 comprising a line 22. The length of riser 20 is such that it extends over a certain length of the drain hole in the producing layer. A plurality of orifices 23 allows the presence of fluid jets 24 in drain hole 3. The outside diameter of the riser is compatible with the section of flow of the stator in which the rotor is placed. In fact, during setting thereof, the riser has to run through the stator.

Thus, the riser is brought into rotation in the drain hole when the pumping means are activated, i.e. when the continuous tubing drives the rotor of the pump into rotation. During injection of a fluid into the continuous tubing, this fluid spurts out of the riser in form of rotary jets, thus favouring contact of this injected fluid with the effluent produced by the geologic formation and flowing through the drain hole. In particular, in the case of heavy or viscous oil, the injected fluid can be an agent intended to lower the viscosity of the effluent produced: hot steam, hot water, chemical or physical solvent, or functionally equivalent products.

The distribution of the orifices depends on the distribution of the production flow rates of the formation through which the drain hole runs. The diameter of the holes can be different depending on the upstream pressure, so as to obtain a good distribution of the injected fluid.

The drain hole into which the riser is lowered can be an open hole cased by means of a liner or of a perforated tube, or cased, cemented, then perforated.

In a production mode variant, the heavy oil can be emulsified in water admixed with emulsifying products, the additive-containing water being injected through the continuous tube.

The invention is not limited to a system comprising a continuous driving tube, although it is an advantageous embodiment. A driving string consisting of an assembly of tube elements can be suitable within the scope of the present invention.

The invention claimed is:

1. A system for pumping an effluent produced by a well drilled through a producing geologic formation, comprising:

a production string:

a tubular driving string arranged in an inner space of said production string, said driving string having an inner space for injecting a fluid;

pumping means arranged in the lower part of the well so as to be immersed in said effluent, said pumping means comprising a rotor and a stator;

said stator being fastened to a base of the production string;

said rotor being fastened by a first end to the driving string;

means for driving said driving string into rotation so as to activate the pump, characterized in that a riser comprising at least one orifice is fastened to the rotor at the second end thereof, said rotor comprising a line communicating the inner space of the driving string with the inner space of the riser.

2. A system as claimed in claim 1, wherein said riser comprises a plurality of orifices distributed over the length thereof.

3. A system as claimed in claim 1, wherein the dimension of said orifice is so determined that a fluid injected into the driving string comes out of the riser in form of a jet.

4. A system as claimed in claim 1, wherein the riser is made of composite polymer.

5. A system as claimed in claim 1, wherein the length of the riser is determined as a function of the length of an effluent production drain hole.

6. A system as claimed in claim 1, wherein the well is cased and the pumping means are arranged in a casing string.

7. A method for producing by pumping an effluent produced by a well drilled through a producing geologic formation, wherein the system as claimed in claim 1 is implemented, and wherein a fluid suited to lower the viscosity of the effluent is injected into the driving string.

8. A method as claimed in claim 7, wherein at least one of the following fluidifiers is injected: hot water, steam, naphtha.

9. A method as claimed in claim 7, wherein said fluid is suited to emulsify said effluent.

* * * * *